US007263728B2

(12) United States Patent
England

(10) Patent No.: US 7,263,728 B2
(45) Date of Patent: Sep. 4, 2007

(54) DUAL ACTUATION BUTTON ASSEMBLY

(75) Inventor: Sam Robertson England, Marden (AU)

(73) Assignee: Caroma Industries Limited, Brisbane, Queensland (AU)

( * ) Notice: Subject to any disclaimer, the term of this patent is extended or adjusted under 35 U.S.C. 154(b) by 0 days.

(21) Appl. No.: 10/527,276

(22) PCT Filed: Aug. 28, 2003

(86) PCT No.: PCT/AU03/01109

§ 371 (c)(1),
(2), (4) Date: Sep. 8, 2005

(87) PCT Pub. No.: WO2004/027170

PCT Pub. Date: Apr. 1, 2004

(65) Prior Publication Data

US 2006/0137084 A1 Jun. 29, 2006

(30) Foreign Application Priority Data

Sep. 19, 2002 (AU) ..... 2002951505

(51) Int. Cl.
*E03D 5/09* (2006.01)

(52) U.S. Cl. ..... 4/410

(58) Field of Classification Search ..... 4/324–327, 4/366, 405, 410
See application file for complete search history.

(56) References Cited

U.S. PATENT DOCUMENTS

| | | | | |
|---|---|---|---|---|
| 5,331,690 | A | 7/1994 | Pourcier | |
| 6,442,772 | B2 * | 9/2002 | Han et al. | 4/325 |

FOREIGN PATENT DOCUMENTS

| | | |
|---|---|---|
| AU | A-43434/85 | 6/1984 |
| EP | 0 578 892 | 7/1992 |
| EP | 0 727 533 | 2/1996 |
| WO | WO 02/075063 | 9/2002 |

* cited by examiner

*Primary Examiner*—Huyen Le
(74) *Attorney, Agent, or Firm*—Merchant & Gould P.C.

(57) ABSTRACT

A dual actuation button assembly (10) for a dual volume flush cistern. The assembly includes dual actuation button members (14, 16) which are both adapted for movement upon actuation in a common actuation direction. A single spring (18) is adapted to apply a force to both of the button members (14, 16) in a direction opposite to the actuation direction. The spring (18) is adapted to maintain some of said force on one (14,16) of the button members during actuating movement of the other of the button members (16, 14).

9 Claims, 3 Drawing Sheets

DUAL ACTUATION BUTTON ASSEMBLY

FIELD OF THE INVENTION

The present invention relates to a dual actuation button assembly for a dual volume flush cistern. A cistern is known as a flush tank in the United States of America.

BACKGROUND OF THE INVENTION

Known dual volumes flush cisterns have dual actuation buttons that allow a user to select between a full or partial volume flush. The buttons generally move between an upper rest position and a lower actuated position and are each biased to the rest position by a respective spring. These known dual spring arrangements are complicated to produce and assemble, and thus expensive.

OBJECT OF THE INVENTION

It is an object of the present invention to provide a dual actuation button assembly of simplified construction and assembly compared to those of the prior art.

SUMMARY OF THE INVENTION

Accordingly, the present invention provides a dual actuation button assembly for a dual volume flush cistern, the assembly including:

dual actuation button members, both adapted for movement upon actuation in a common actuation direction; and a single spring adapted to apply a force to both of the button members in a direction opposite to the actuation direction, wherein the spring is adapted to maintain some of said force on one of the button members during actuating movement of the other of the button members.

The button members are preferably mounted either side of the spring and each include a portion adapted to commonly abut a moveable end of the spring.

In one form, the button members include an integral exposed button part adapted for movement by a user. In another form, the button members are adapted to move in response to movement of an associated exposed button part, the button part being adapted for movement by a user.

The assembly preferably includes a bridge member adapted for mounting to, or forming part of, a cistern. The end of the spring opposite the moveable end is preferably mounted to the bridge member. The button members are preferably mounted for movement relative to the bridge member.

The button members are preferably adapted to move between a rest and an actuated position. The height of the spring is preferably sized to be slightly in compression when both of the buttons are in the rest position. The width of the spring is preferably sized to remain at least slightly in compression against one of the buttons in the rest position whilst the other of the buttons is in the actuated position.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENT

Figure 1:
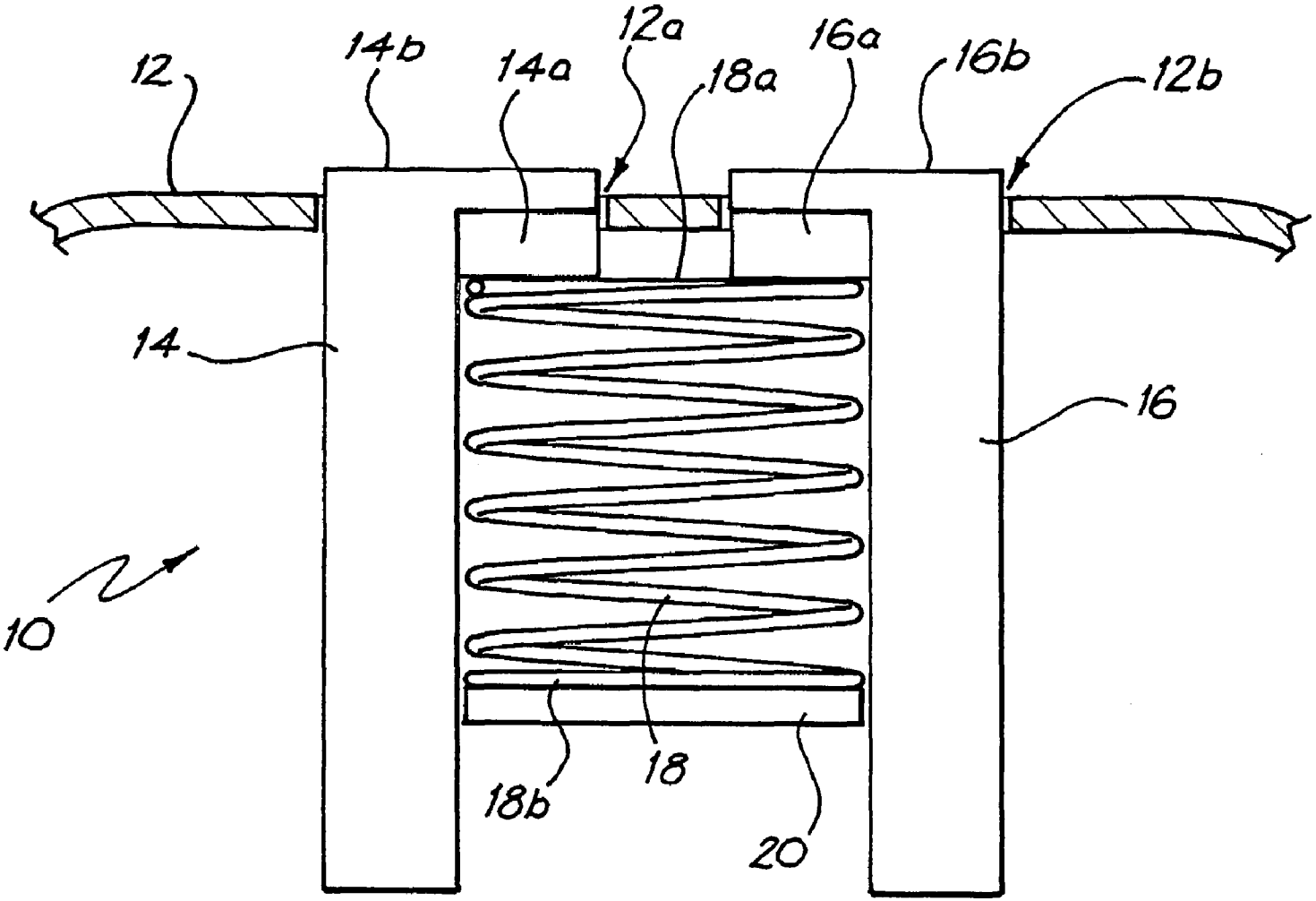
FIG. 1 is a schematic side view of an embodiment of a dual actuation button assembly according to the invention, with both button members shown in the rest position.

Referring firstly to FIG. 1, there is shown an embodiment of a dual actuation button assembly 10 according to the invention. The assembly 10 is configured for use within a dual volume flush cistern having a lid 12. The assembly 10 includes a pair of actuation button members 14 and 16 and a single spring 18.

The button members 14, 16 are mounted either side of the spring 18 and include a portion 14*a* and 16*a* respectively that is adapted to abut a movable end 18*a* of the spring 18. A fixed end of the spring 18*b* abuts a bridge member 20 which is fixed relative to the cistern. The button members 14, 16 also each include a part 14*b*, 16*b* respectively, which protrude through corresponding openings 12*a*, 12*b* in the lid 12 so as to be exposed for actuation by a user. The button members 14, 16 are adapted, upon being depressed by a user, to move from an upper rest position to a lower actuated position.

FIG. 1 shows both the button members 14, 16 being maintained in the rest position. In this position, the spring 18 is slightly compressed and therefore provides a force to each of the button members 14, 16 to bias them into, and maintain them in, the rest position.

Figure 2:
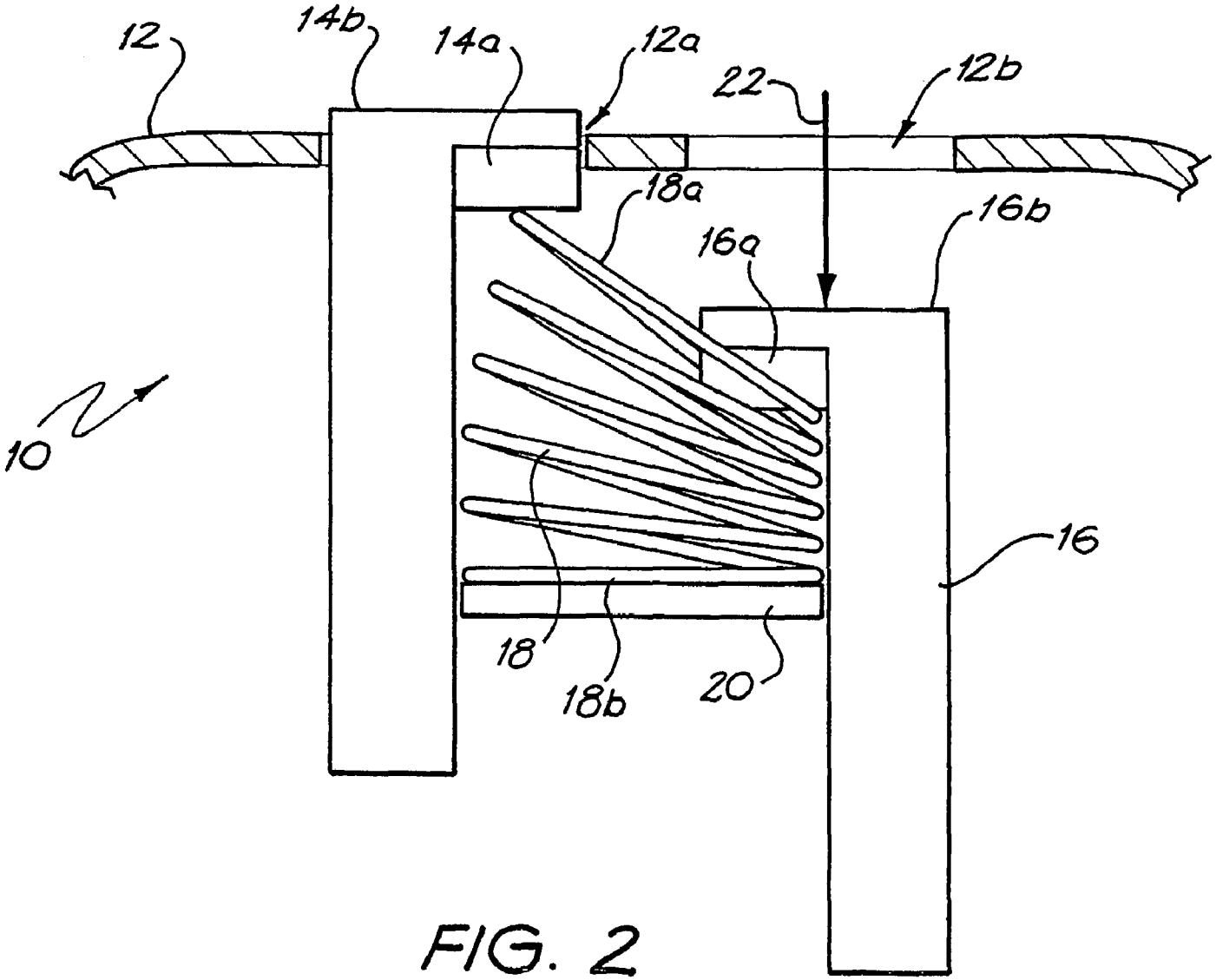
FIG. 2 is a schematic side view of the assembly shown in FIG. 1, with one of the button members shown in the rest position and the other of the button members shown in the actuated position.

FIG. 2 shows the button member 14 in the rest position and the button member 16 in the actuated position as a result of depression in the direction of arrow 22. Importantly, FIG. 2 demonstrates that the width of the spring 18 is sufficient to maintain the button member 14 in the rest position whilst the button member 16 is in the actuated position. Put another way, the side of the spring 18 adjacent the button member 14 is slightly compressed and still provides a biasing force to the button member 14. It will be understood that the button member 16 is similarly maintained in the rest position during movement of button member 14 to the actuated position.

Figure 3:
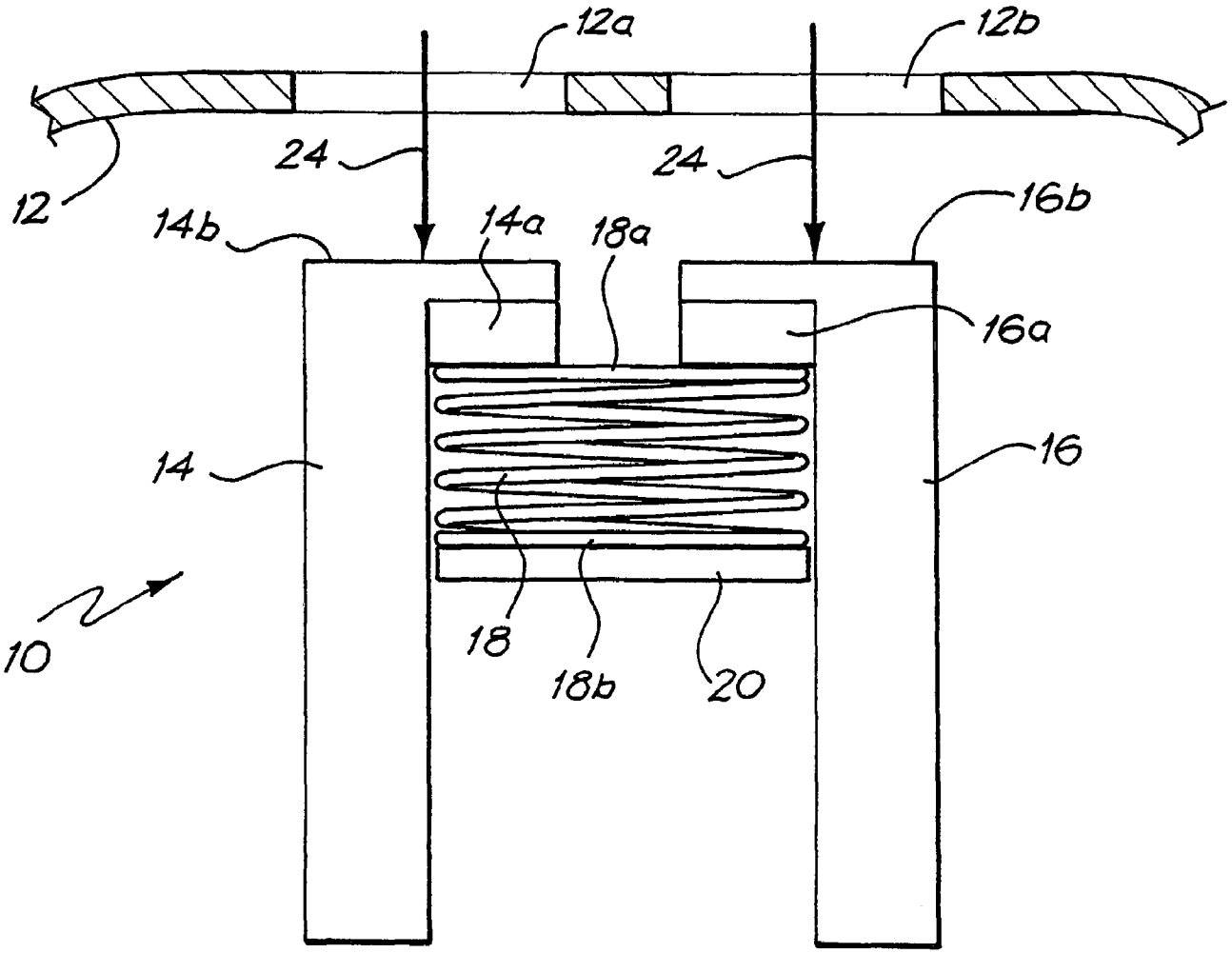
FIG. 3 is a schematic side view of the assembly shown in FIG. 1, with both of the button members shown in the actuated position.

FIG. 3 shows how the spring 18 is evenly compressed on both sides if both button members 14, 16 are depressed by a user to the actuation position in the direction of arrows 24.

The advantage of the dual actuation button assembly described above is that it has less parts than dual spring actuation button assemblies and is less complicated to produce and construct than known assemblies, which reduces expense.

Although the invention has been described with reference to a preferred embodiment, it will be appreciated by those skilled in the art that the invention may be embodied in many other forms. For example, in the embodiment described above, the button members have a part which protrudes through respective openings in the cistern lid for direct contact and actuation by a user. However, in other embodiments, the button members may be concealed within the cistern and move in response to movement of other components that are available for actuation by a user.

The claims defining the invention are as follows:

1. A dual actuation button assembly for a dual volume flush cistern, the assembly including: dual actuation button members, both adapted for movement upon actuation in a common actuation direction; and a single spring adapted to apply a force to both of the button members in a direction opposite to the actuation direction, wherein the button members are mounted to the outside of and on opposing sides of the spring and extend along a length of the spring, and each include a portion adapted to commonly abut a moveable end of the spring, and the spring is adapted to maintain some of said force on one of the button members during actuating movement of the other of the button members.

2. The assembly as claimed in claim 1, wherein the button members include an integral exposed button part adapted for movement by a user.

3. The assembly as claimed in claim 1, wherein the button members are adapted to move in response to movement of an associated exposed button part the button part being adapted for movement by a user.

4. The assembly as claimed in claim 1, wherein the assembly includes a bridge member that is fixed relative to a cistern.

5. The assembly as claimed in claim 4, wherein the end of the spring opposite the moveable end is mounted to the bridge member.

6. The assembly as claimed in claim 4, wherein the button members are mounted for movement relative to the bridge member.

7. The assembly as claimed in claim 1, wherein the button members are adapted to move between a rest and an actuated position.

8. The assembly as claimed in claim 7, wherein the height of the spring is sized to be slightly in compression when both of the buttons are in the rest position.

9. The assembly as claimed in claim 7, wherein the width of the spring is sized to remain at least slightly in compression against one of the buttons in the rest position whilst the other of the buttons is in the actuated position.

* * * * *